US006010212A

United States Patent [19]

Yamashita et al.

[11] Patent Number: 6,010,212

[45] Date of Patent: Jan. 4, 2000

[54] INK CARTRIDGE

[75] Inventors: Takeshi Yamashita, Kawanishi; Tomoko Yamamoto, Takarazuka; Hitoshi Kato, Itami, all of Japan

[73] Assignee: Minolta Co., Ltd., Osaka, Japan

[21] Appl. No.: 08/874,923

[22] Filed: Jun. 13, 1997

[30] Foreign Application Priority Data

Jun. 13, 1996 [JP] Japan ..... 8-175897

[51] Int. Cl.[7] ..... B41J 2/175

[52] U.S. Cl. ..... 347/86

[58] Field of Search ..... 347/84, 85, 86, 347/87

[56] References Cited

U.S. PATENT DOCUMENTS

| | | | |
|---|---|---|---|
| 5,481,289 | 1/1996 | Arashima et al. | 347/93 |
| 5,604,523 | 2/1997 | Tsukuda et al. | 347/86 |

FOREIGN PATENT DOCUMENTS

| | | |
|---|---|---|
| 0631874 | 1/1995 | European Pat. Off. . |
| 06249925 | 9/1994 | Japan . |
| 07052404 | 2/1995 | Japan . |
| 07068785 | 3/1995 | Japan . |

*Primary Examiner*—N. Le
*Assistant Examiner*—Michael Nghiem
*Attorney, Agent, or Firm*—Sidley & Austin

[57] ABSTRACT

An ink cartridge for supplying ink to a recording head in the present invention is provided with an ink containing section containing the ink, an ink supply port for supplying the ink to the recording head, a vent hole for introducing air into the ink cartridge, a first holding member containing section containing an ink holding member for holding the ink between the ink containing section and the ink supply port, and a second holding member containing section containing the ink holding member for holding the ink between the ink containing section and the vent hole, the first holding member containing section and the second holding member containing section not communicating with each other.

23 Claims, 4 Drawing Sheets

INK CARTRIDGE

BACKGROUND OF THE INVENTION

1. Field of the Invention

The present invention relates generally to an ink cartridge used for supplying ink to a recording head in an ink jet recorder, and more particularly, to an ink cartridge capable of stably supplying ink to a recording head.

2. Description of the Related Art

Conventionally, in discharging ink from a recording head to record image using in an ink jet recorder, ink contained in an ink cartridge is supplied to the recording head from the ink cartridge.

Various ink cartridges have been conventionally used as such an ink cartridge. One example of the ink cartridge is an ink cartridge as shown in FIG. 1.

In the ink cartridge, an ink supply port 11 for supplying ink 1 to a recording head (not shown) is provided in a bottom surface 10*a* of a cartridge 10 formed in a box shape. The vent hole 12 for introducing air into the cartridge 10 is provided in a lower part of a side surface 10*b*, which is spaced apart from the ink supply port 11, of the cartridge 10. A partition plate 13 having a plurality of holes is provided in the cartridge 10. The partition plate 13 separates the cartridge 10 into an ink containing section 14 containing the ink 1 and a holding member containing section 15 containing an ink holding member 20 composed of a sponge or the like for holding ink. The ink 1 is contained in the ink containing section 14, and the ink 1 is held in the ink holding member 20 in the holding member containing section 15.

In the ink cartridge, the ink 1 held in the ink holding member 20 provided in the cartridge 10 is supplied to the recording head through the ink supply port 11, while the air is introduced into the cartridge 10 through the vent hole 12, to keep the inside of the cartridge 10 at a predetermined pressure.

When the ink in the ink cartridge is supplied to the recording head at high speed, for example, at the time of purging when the ink is supplied to the recording head through the ink supply port 11 at a speed which is approximately 10 to 100 times the normal speed in order to clean the recording head, air introduced into the cartridge 10 from the vent hole 12 is introduced into the ink supply port 11 through a clearance between the ink holding member 20 and an inner wall of the cartridge 10, for example. The air, taking the form of air bubbles, is introduced into the recording head through the ink supply port 11, and the recording head is clogged with the air bubbles, whereby the ink cannot be satisfactorily discharged, resulting in insufficient printing, for example.

SUMMARY OF THE INVENTION

The present invention has been made in order to solve the above-mentioned problems in an ink cartridge for supplying ink to a recording head in an ink jet recorder.

An object of the present invention is to inhibit, even when ink is supplied to a recording head through an ink supply port at high speed as described above, air flowing into a cartridge through a vent hole from being introduced into the ink supply port through a clearance between an ink holding member and an inner wall of the cartridge, for example.

Another object of the present invention is to prevent a recording head from being clogged with air bubbles to prevent insufficient printing, thereby making it possible to stably discharge ink from the recording head.

An ink cartridge for supplying ink to a recording head according to the present invention is provided with an ink containing section containing ink, an ink supply port for supplying the ink to the recording head, a vent hole for introducing air into the cartridge, a first holding member containing section containing an ink holding member for holding ink between the ink containing section and the ink supply port, and a second holding member containing section containing ink holding member between the ink containing section and the vent hole, where the first holding member containing section and the second holding member containing section are not in direct communication.

In a case where the first holding member containing section containing an ink holding member between the ink containing section containing the ink and the ink supply port and the second holding member containing section containing an ink holding member between the ink containing section and the vent hole are separated from each other as in the ink cartridge according to the present invention, if the air is introduced into the cartridge from the vent hole when the ink is supplied to the recording head from the ink supply port, the air is first introduced into the second holding member containing section, after which the air flows into the ink containing section. Therefore, the air introduced into the cartridge from the vent hole is prevented from being introduced into the ink supply port through the clearance between the ink holding member and the inner wall of the cartridge, for example, as in the conventional ink cartridge.

As a result, in the ink cartridge according to the present invention, when the ink is supplied to the recording head through the ink supply port at high speed, the air introduced into the cartridge through the vent hole is prevented from being supplied to the recording head from the ink supply port, and the ink is stably supplied to the recording head through the ink supply port, to prevent insufficient printing, for example. Therefore, printing can be stably done.

When the second holding member containing section is provided between the ink containing section and the vent hole, it is preferable that a space is further provided between the ink holding member of the second holding member containing section and the vent hole in order to prevent the ink held in the ink holding member contained in the second holding member containing section from leaking outward through the vent hole.

There and other objects, advantages and features of the invention will become apparent from the following description thereof taken in conjunction with the accompanying drawings which illustrate specific embodiment of the invention.

DESCRIPTION OF THE PREFERRED EMBODIMENTS

Embodiments of an ink cartridge according to the present invention will be specifically described on the basis of accompanying drawings. Further, it will be made clear by giving comparative examples that in a case where the ink cartridge in the present embodiment is used, ink is stably supplied to a recording head even when the ink is supplied to the recording head at high speed.

(Embodiment 1)

Figure 1:
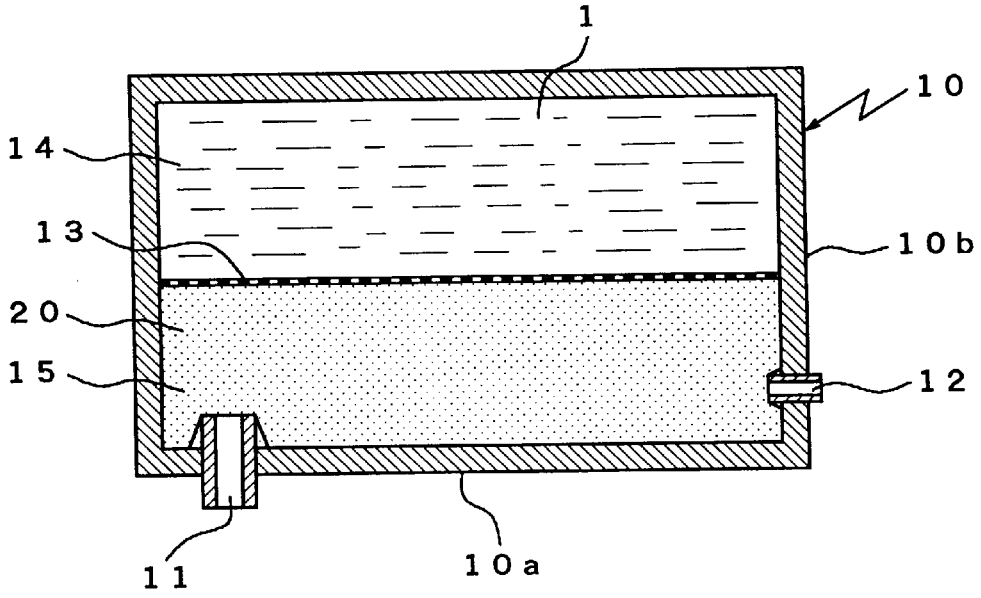
Fig1 prior art
FIG. 1 is a schematic cross-sectional view showing the state of a conventional ink cartridge.
Figure 2:
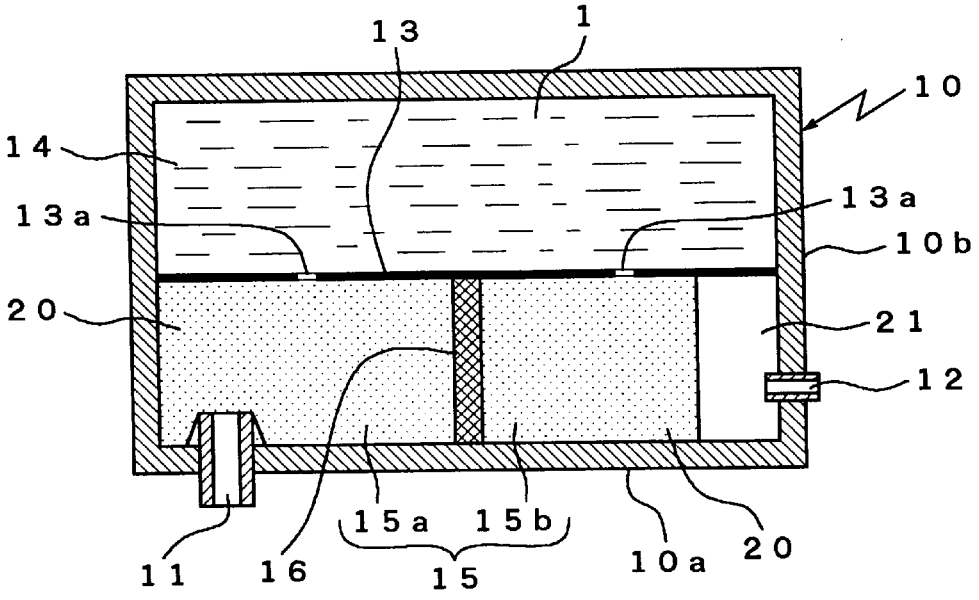
FIG. 2 is a schematic cross-sectional view showing a first embodiment of an ink cartridge of the present invention.

In an ink cartridge according to the present embodiment, a cartridge 10 in the shape of a box having a height of 20 mm, a depth of 20 mm and a width of 35 mm is formed using translucent ABS resin. The cartridge 10 has an ink supply port 11 for supplying ink 1 to a recording head in a bottom surface 10*a* of the cartridge 10 and a vent hole 12, which is spaced apart from the ink supply port 11, for introducing air into the cartridge 10 in a lower part of a side surface 10*b* of the cartridge 10, as shown in FIG. 2.

A partition plate 13*a* having a communicating hole 13 provided in a suitable position is so arranged as to separate the cartridge 10 into upper and lower parts. The partition plate 13 separates the cartridge 10 into an ink containing section 14, containing the ink 1 on the side of the upper part, and a holding member containing section 15 containing an ink holding members 20*a*, 20*b* on the side of the lower part.

Furthermore, a barrier wall 16 is provided in the holding member containing section 15. The barrier wall 16 separates the holding member containing section 15 into a first holding member containing section 15*a* containing the ink holding member 20*a* between the ink containing section 14 and the ink supply port 11 and a second holding member containing section 15*b* containing the ink holding member 20*b* between the ink containing section 14 and the vent hole 12.

A polyurethane sponge having a specific gravity of 0.052 g/cc and an average hole diameter of 0.2 mm is used as the above-mentioned ink holding members 20*a*, 20*b*. In containing the ink holding member 20*a* in the first holding member containing section 15*a*, the first holding member containing section 15*a* is filled with the ink holding member 20*a* having a volume which is 1.5 times the volume of the first holding member containing section 15*a* in such a manner that the ink holding member 20*a* is brought into contact with the ink supply port 11. In containing the ink holding member 20*b* in the second holding member containing section 15*b*, a space 21 is provided between the ink holding member 20*b* and the vent hole 12 in order that the ink holding member 20*b* is not brought into contact with the vent hole 21, and a portion, which excludes the space 21, of the second holding member containing section 15*b* is filled with the ink holding member 20*b* having a volume which is 1.5 times the volume of the portion.

In thus containing the ink holding member 20*b* in the second holding member containing section 15*b*, the communicating hole 13*a* provided in the partition plate 13 is covered with the ink holding member 20*b* so that the ink 1 contained in the ink containing section 14 does not flow into the space 21 through the communicating hole 13*a*.

Ink 1 is a water-based ink having a viscosity of 2 cP and a surface tension of 30 dyn/cm, the ink 1 is contained in the ink containing section 14, and the ink holding members 20*a*, 20*b* contained in each of the holding member containing sections 15*a*, 15*b* is impregnated with the ink 1.

(Embodiment 2)

Figure 3:
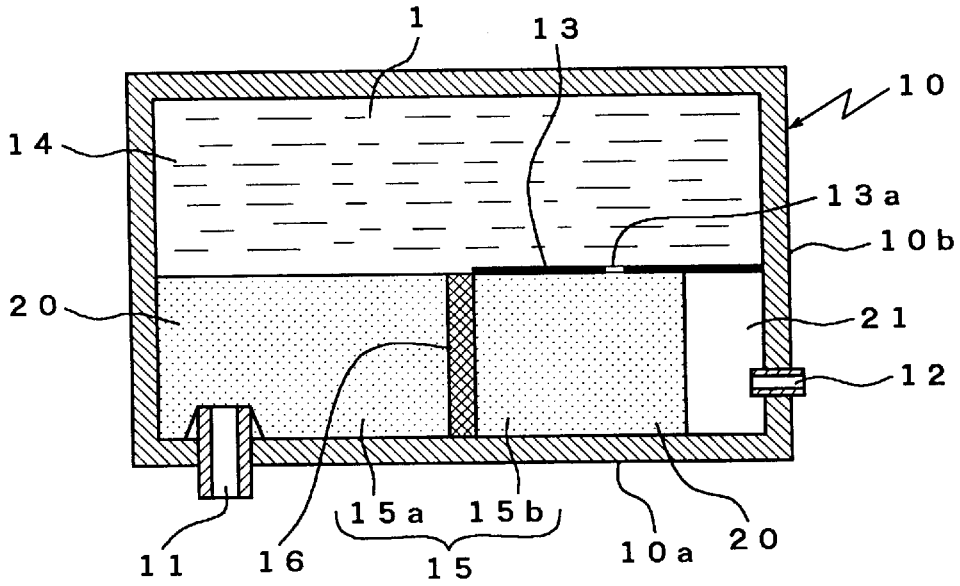
FIG. 3 is a schematic cross-sectional view showing a second embodiment of an ink cartridge of the present invention.

An ink cartridge according to the present embodiment is so adapted that in a ink cartridge according to the above-mentioned embodiment 1, a partition plate 13 is only provided between an ink containing section 14 and a second holding member containing section 15*b* without being provided between the ink containing section 14 and a first holding member containing section 15*a* in a cartridge 10, so that ink 1 contained in the ink containing section 14 and an ink holding member 20*a* contained in the first holding member containing section 15*a* are brought into contact with each other, as shown in FIG. 3.

In the present embodiment, a polyurethane sponge having a specific gravity of 0.13 g/cc and an average hole diameter of 0.2 mm is used as the ink holding members 20*a*, 20*b*. In containing the ink holding member 20*a* in the first holding member containing section 15*a*, the first holding member containing section 15*a* is filled with the ink holding member 20*a* having a volume which is 1.2 times the volume of the first holding member containing section 15*a* in such a manner that the ink holding member 20*a* is brought into contact with the ink supply port 11. On the other hand, in containing the ink holding member 20*b* in the second holding member containing section 15*b*, a space 21 is provided between the ink holding member 20*b* and a vent hole 12 in order that the ink holding member 20*b* is not brought into contact with the vent hole 12, and a portion, which excludes the space 21, of the second holding member containing section 15*b* is filled with the ink holding member 20*b* having a volume which is 1.2 times the volume of the portion.

(Embodiment 3)

Figure 4:
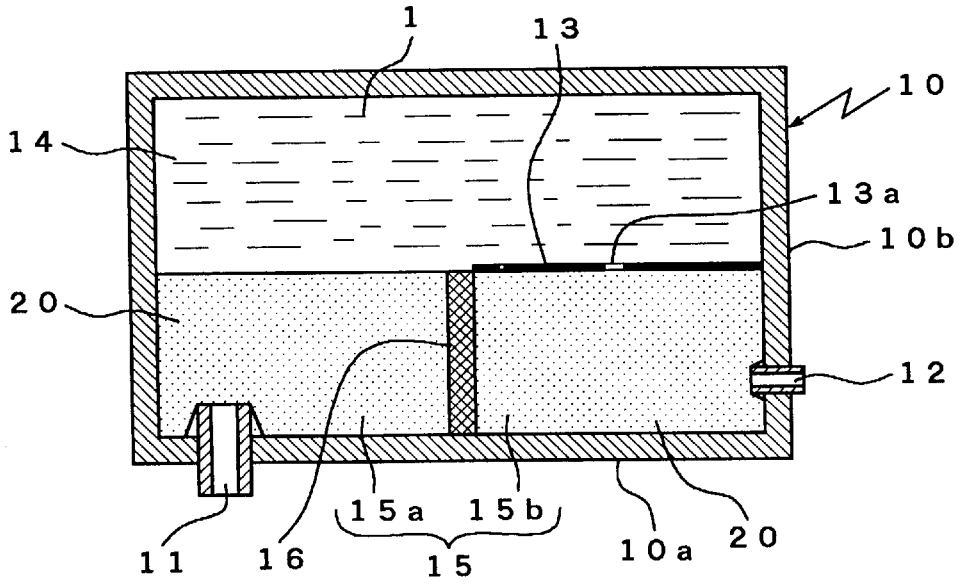
FIG. 4 is a schematic cross-sectional view showing a third embodiment of an ink cartridge of the present invention.

An ink cartridge according to the present embodiment is approximately the same as the ink cartridge according to the above-mentioned embodiment 2 except that no space is provided between a ink holding member 20*b* and a vent hole 12, so that the ink holding member 20*b* is contained in the whole of the second holding member containing section 15*b*, as shown in FIG. 4.

In the present embodiment, a polyurethane sponge having a specific gravity of 0.047 g/cc and an an average hole diameter of 0.5 mm is used as the ink holding members 20*a*, 20*b*. A first holding member containing section 15*a* and the second holding member containing section 15*b* are respectively filled with ink holding members 20*a*, 20*b* having volumes which are respectively 1.2 times their holding volumes of the sections.

(Embodiment 4)

Figure 5:
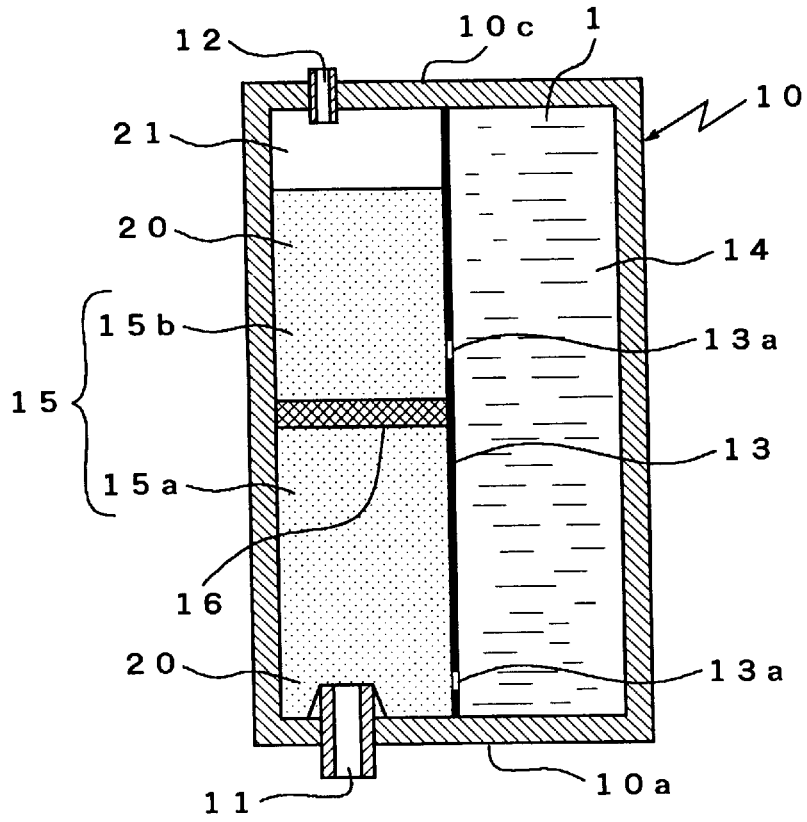
FIG. 5 is a schematic cross-sectional view showing a fourth embodiment of an ink cartridge of the present invention.

In an ink cartridge according to the present embodiment, a cartridge 10 in the shape of a box having a height of 35 mm, a depth of 20 mm and a width of 20 mm is formed using translucent ABS resin. A partition plate 13 is so arranged in the vertical direction as to separate a cartridge 10 into right and left parts, and a communicating hole 13*a* is provided in a suitable position of the partition plate 13, as shown in FIG. 5. The partition plate 13 separates the cartridge 10 into an ink containing section 14 containing ink 1 on the right side and a holding member containing section 15 containing ink holding members 20*a*, 20*b* on the left side.

On the side of the holding member containing section 15 thus containing the ink holding members 20*a*, 20*b*, an ink supply port 11 is provided in a bottom surface 10*a* of the cartridge 10, while a vent hole 12 is provided in an upper surface 10*c* thereof. A barrier wall 16 is so provided as to separate the holding member containing section 15 into upper and lower parts. The barrier wall 16 separates the holding member containing section 15 into a first holding member containing section 15*a* containing the ink holding member 20*a* on the side of the ink supply port 11 and a second holding member containing section 15*b* containing the ink holding member 20*b* on the side of the vent hole 12.

A polyurethane sponge having a specific gravity of 0.052 g/cc and an average hole diameter of 0.2 mm is used as the above-mentioned ink holding members 20*a*, 20*b*. In containing the ink holding member 20*a* in the first holding member containing section 15*a*, the first holding member containing section 15*a* is filled with the ink holding member 20*a* having a volume which is 1.5 times the volume of the first holding member containing section 15*a* in such a manner that the ink holding member 20*a* is brought into contact with the ink supply port 11. On the other hand, in containing the ink holding member 20*b* in the second holding member containing section 15*b*, a space 21 is provided between the ink holding member 20*b* and the vent hole 12 in order that the ink holding member 20*b* is not brought into contact with the vent hole 12, and a portion, which excludes the space 21, of the second holding member containing section 15*b* is filled with the ink holding member 20*b* having a volume which is 1.5 times the volume of the portion.

The same water based ink as that in the above-mentioned embodiment 1 is used as the ink 1. The ink 1 is contained in the ink containing section 14, and the ink holding members 20*a*, 20*b* contained in each of the holding member containing sections 15*a*, 15*b* are impregnated with the ink 1.

COMPARATIVE EXAMPLE 1

Figure 6:
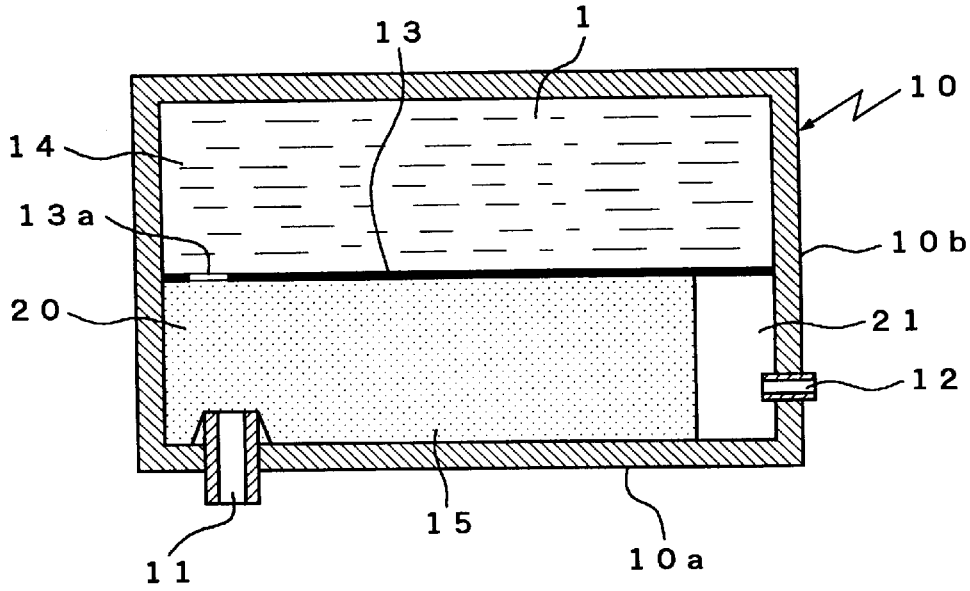
FIG. 6 is a schematic cross-sectional view showing a first comparative example of an ink cartridge.

An ink cartridge in this comparative example is so adapted that in the ink cartridge according to the above-mentioned embodiment 1, a barrier wall 16 is not provided in a holding member containing section 15 containing an ink holding member 20, as shown in FIG. 6.

COMPARATIVE EXAMPLE 2

Figure 7:
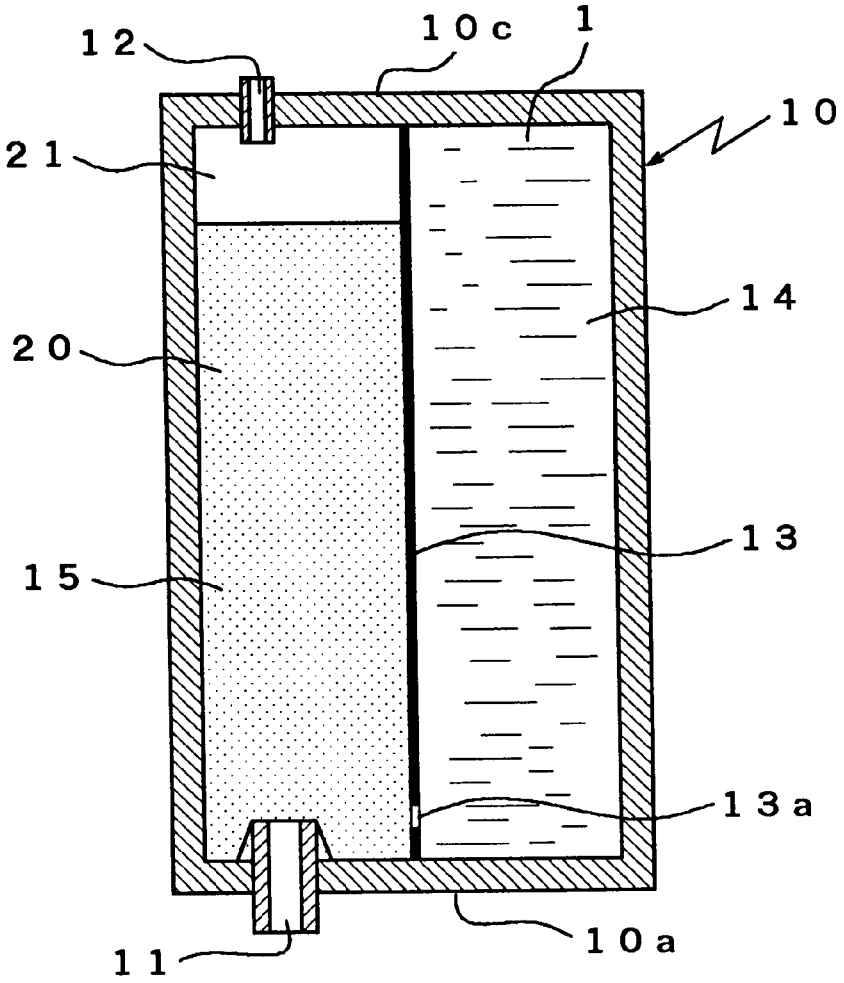
FIG. 7 is a schematic cross-sectional view showing a second comparative example of an ink cartridge.

An ink cartridge in this comparative example is so adapted that in the ink cartridge according to the above-mentioned embodiment 4, a barrier wall 16 is not provided in a holding member containing section 15 containing an ink holding member 20, as shown in FIG. 7.

With respect to the respective ink cartridges in the embodiments 1 to 4 and the comparative examples 1 and 2, the ink discharge performance was examined, and the results thereof are shown in the following Table 1.

In examining the ink discharge performance in each of the above-mentioned ink cartridges, the states of ink discharged when the ink was respectively drawn from the ink supply port 11 by a tube pump at flow rates of 0.15 ml/min, 1.0 ml/min, 5.0 ml/min, and 10.0 ml/min were examined. A case where the ink with the set flow rate was accurately discharged is indicated by ○, a case where the flow rate of the ink was hardly decreased, although a few air bubbles is indicated by Δ, and a case where the flow rate of the ink was significantly decreased because of the presence of a lot of air bubbles entered was indicated by x.

TABLE 1

| SET FLOW RATE (ml/min) | 0.15 | 1.0 | 5.0 | 10.0 |
|---|---|---|---|---|
| EMBODIMENT 1 | ○ | ○ | ○ | ○ |
| EMBODIMENT 2 | ○ | ○ | ○ | ○ |
| EMBODIMENT 3 | ○ | ○ | ○ | ○ |
| EMBODIMENT 4 | ○ | ○ | ○ | ○ |
| COMPARATIVE EXAMPLE 1 | ○ | ○ | Δ | X |
| COMPARATIVE EXAMPLE 2 | ○ | ○ | ○ | X |

As a result, when as in each of the ink cartridges in the embodiments 1 to 4, the barrier wall 16 is provided in the holding member containing section 15 containing the ink holding members 20*a*, 20*b*, and the barrier wall 16 separates the first holding member containing section 15*a* containing the ink holding member 20*a* between the ink containing section 14 and the ink supply port 11 and the second holding member containing section 15*b* containing the ink holding member 20*b* between the ink containing section 14 and the vent hole 12, the air flowing into the cartridge 10 from the vent hole 12 was inhibited from being introduced into the ink supply port 11. Even when the set flow rate of the ink was increased, no air bubbles flowed in, so that the ink with the set flow rate was accurately discharged through the ink supply port 11.

On the other hand, when as in the ink cartridges in the comparative examples 1 and 2, the holding member containing section 15 is not separated by the barrier wall, and the ink supply port 11 and the vent hole 12 communicate with each other by the holding member containing section 15. As shown, the air bubbles flowed out through the ink supply port 11 as the set flow rate of the ink was increased. When the ink was drawn at a high speed of 10 ml/min, air bubbles rapidly flowed in, and the flow rate of the ink was significantly decreased.

Although the present invention has been fully described by way of examples, it is to be noted that various changes and modification will be apparent to those skilled in the art.

Therefore, unless such changes and modifications depart from the scope of the present invention, they should be construed as being included herein.

What is claimed is:

1. An ink cartridge, having an interior volume, a vent hole, and an ink supply port, for supplying ink to a recording head, the ink cartridge comprising:

an ink containing section to receive an ink;

a first holding member containing section, adjacent to the ink containing section, containing a first ink holding member and being in communication with the ink supply port;

a second holding member containing section, adjacent to the ink containing section, containing a second ink holding member and being in communication with the vent hole; and a partition member, positioned in the interior volume and between the first holding member containing section and the second holding member containing section, to prevent direct fluid communication between the second holding member containing section and the first holding member containing section.

2. An ink cartridge according to claim 1, further comprising a second partition member, positioned within the interior volume, for partitioning the first holding member containing section from the ink containing section and for partitioning the second holding member containing section from the ink containing section, wherein the second partition member has at least two communicating holes by which the second holding member containing section and the first holding member containing section respectively communicate with the ink containing section.

3. An ink cartridge according to claim 2, wherein in the first holding member containing section, the first ink holding member contacts the ink supply port and completely fills the first holding member containing section, and in the second holding member containing section, the second holding member partially fills the second holding member containing section and covers a communicating hole of the second partition member.

4. An ink cartridge according to claim 3, wherein the first and second ink holding members are respectively composed of a porous member having a specific gravity of 0.052 g/cc and an average hole diameter of 0.2 mm.

5. An ink cartridge according to claim 1, further comprising a second partition member, positioned within the interior volume, for partitioning the second holding member containing section from the ink containing section, wherein the second partition member has a communicating hole by which the second holding member containing section and the ink containing section communicate with each other.

6. An ink cartridge according to claim 5, wherein in the first holding member containing section, the first ink holding member contacts the ink supply port and completely fills the first holding member containing section, and in the second holding member containing section, the second holding member partially fills the second holding member containing section and covers the communicating hole of the second partition member.

7. An ink cartridge according to claim 6, wherein the first and second ink holding members are respectively composed of a porous member having a specific gravity of 0.13 g/cc and an average hole diameter of 0.2 mm.

8. An ink cartridge according to claim 5, wherein in the first holding member containing section, the first ink holding member contacts the ink supply port and completely fills the first holding member containing section, and in the second holding member containing section, the second ink holding member covers the communicating hole of the second partition member and completely fills the second holding member containing section.

9. An ink cartridge according to claim 8, wherein the first and second ink holding members are respectively composed of a porous member having a specific gravity of 0.047 g/cc and an average hole diameter of 0.5 mm.

10. An ink cartridge according to claim 1, wherein the vent hole is provided in a side surface of the ink cartridge, and the ink supply port is provided in a lower surface thereof.

11. The ink jet recorder according to claim 10, wherein the ink cartridge is shaped so that a first length of the ink cartridge, which is parallel to a direction of ink discharge through the ink supply port, is less than a second length of the ink cartridge, which is perpendicular to the direction of ink discharge through the ink supply port.

12. An ink cartridge according to claim 1, wherein the vent hole is provided in an upper surface of the ink cartridge, and the ink supply port is provided in a lower surface thereof.

13. The ink jet recorder according to claim 12, wherein the ink cartridge is shaped so that a first length of the ink cartridge, which is parallel to a direction of ink discharge through the ink supply port, is greater than a second length of the ink cartridge, which is perpendicular to the direction of ink discharge through the ink supply port.

14. An ink cartridge for supplying ink to a recording head, the ink cartridge comprising:

a cartridge housing having an interior chamber, a vent hole, an ink supply port, and at least one partition to divide the interior chamber of the housing into:

an ink containing section to receive and to store ink, a first holding member containing section, being in fluid communication with the ink containing section, and a second holding member containing section, being in fluid communication with the ink containing section, wherein a first partition separates the first holding member containing section from the second holding member containing section to prevent direct fluid communication therebetween.

15. An ink cartridge in accordance with claim 14, further comprising:

a first ink containing member, positioned within the first holding member containing section, and a second ink containing member, positioned within the second holding member containing section.

16. An ink cartridge in accordance with claim 15, wherein the vent hole opens into the first holding member containing section, and the ink supply port opens into the second holding member containing section.

17. An ink cartridge in accordance with claim 15, wherein the vent hole opens into the first holding member containing section, and the ink supply port opens into the second holding member containing section, and the second ink containing member contacts the ink supply port.

18. An ink cartridge in accordance with claim 14, wherein a second partition separates the ink containing section from the first and second holding member containing sections and includes at least one communicating orifice.

19. An ink cartridge in accordance with claim 18, wherein the ink containing section and the first holding member containing section communicate through a communicating orifice.

20. An ink cartridge in accordance with claim 18, wherein the ink containing section and the second holding member containing section communicate through a communicating orifice.

21. An ink cartridge, having at least an interior volume, a vent hole, and an ink supply port, for supplying ink to a recording head, the ink cartridge comprising:

an ink containing section to receive an ink;

a first holding member containing section, in direct fluid communication with the ink containing section, containing a first ink holding member and including the ink supply port to supply ink to the recording head;

a second holding member containing section, in direct fluid communication with the ink containing section, containing a second ink holding member and including the vent hole to introduce air into the ink cartridge; and a partition member to separate the first holding member containing section and the second holding member containing section, wherein the first and second holding member containing sections can only communicate indirectly via the ink containing section.

22. An ink cartridge in accordance with claim 21, further comprising a second partition member, positioned within the interior volume, to substantially segregate the first holding member containing section from the ink containing section, wherein the second partition member includes a communicating hole to enable fluid communication therethrough.

23. An ink cartridge in accordance with claim 21, further comprising a second partition member, positioned within the interior volume, to substantially segregate the second holding member containing section from the ink containing section, wherein the second partition member includes a communicating hole to enable fluid communication therethrough.

* * * * *